United States Patent [19]

Kuh et al.

[11] 4,030,920

[45] June 21, 1977

[54] PROCESSING COMPOSITIONS CONTAINING GLYCOLS FOR COLOR TRANSFER PROCESSES COMPRISING DIRECT POSITIVE SILVER HALIDE DEVELOPEMENT

[75] Inventors: Arthur David Kuh, Penfield; Paul Brainard Condit, Rochester, both of N.Y.

[73] Assignee: Eastman Kodak Company, Rochester, N.Y.

[22] Filed: Apr. 12, 1976

[21] Appl. No.: 675,660

[52] U.S. Cl. ..... 96/29 D; 96/3; 96/64; 96/73; 96/76 C; 96/77

[51] Int. Cl.[2] ..... G03C 7/00; G03C 5/54; G03C 1/40; G03C 5/24

[58] Field of Search ..... 96/3, 29 D, 73, 76 C, 96/77, 66 R, 66.3, 66.1, 64

[56] References Cited

UNITED STATES PATENTS

| | | | |
|---|---|---|---|
| 2,191,502 | 2/1940 | Sease et al. | 96/74 |
| 2,304,925 | 12/1942 | Jelly | 96/55 |
| 2,371,740 | 3/1945 | Dearing et al. | 96/66.3 |
| 2,543,181 | 2/1951 | Land | 96/76 R |
| 2,563,785 | 8/1951 | Ives | 96/64 |
| 2,588,982 | 3/1952 | Ives | 96/64 |
| 2,592,250 | 4/1952 | Davey et al. | 96/107 |
| 2,857,275 | 10/1958 | Land et al. | 96/29 R |
| 2,909,430 | 10/1959 | Rogers | 96/29 R |
| 2,983,606 | 5/1961 | Rogers | 96/3 |
| 3,128,182 | 4/1964 | Bard et al. | 96/61 R |
| 3,227,552 | 1/1966 | Whitmore | 96/3 |
| 3,246,987 | 4/1966 | Hanson et al. | 96/59 |
| 3,362,819 | 1/1968 | Land | 96/77 |
| 3,362,821 | 1/1968 | Land | 96/77 |
| 3,415,644 | 12/1968 | Land | 96/77 |
| 3,415,645 | 12/1968 | Land | 96/77 |
| 3,415,646 | 12/1968 | Land | 96/77 |
| 3,443,939 | 5/1969 | Bloom et al. | 96/3 |
| 3,443,940 | 5/1969 | Bloom et al. | 96/3 |
| 3,455,685 | 7/1969 | Carlson et al. | 96/77 |
| 3,552,969 | 1/1971 | Henn et al. | 96/66 R |
| 3,574,619 | 4/1971 | Sutash | 96/66.1 |
| 3,576,633 | 4/1971 | Henn et al. | 96/66.5 |
| 3,615,615 | 10/1971 | Lincoln | 96/64 |
| 3,619,185 | 11/1971 | Kasman | 96/29 R |
| 3,619,198 | 11/1971 | Yamamoto et al. | 96/107 |
| 3,635,707 | 1/1972 | Cole | 96/3 |
| 3,640,721 | 2/1972 | Ishihara et al. | 96/114.4 |
| 3,645,731 | 2/1972 | Liebe et al. | 96/29 R |
| 3,647,437 | 3/1972 | Land | 96/77 |
| 3,698,897 | 10/1972 | Gompf et al. | 96/3 |
| 3,718,470 | 2/1973 | Spence et al. | 96/64 |
| 3,725,062 | 4/1973 | Anderson | 96/3 |
| 3,756,815 | 9/1973 | Schlein et al. | 96/77 |
| 3,761,266 | 9/1973 | Milton | 96/64 |
| 3,761,267 | 9/1973 | Gilman et al. | 96/64 |
| 3,761,276 | 9/1973 | Evans | 96/108 |
| 3,814,606 | 6/1974 | Ozawa et al. | 96/66.1 |
| 3,846,129 | 11/1974 | Kuh | 96/3 |
| 3,923,513 | 12/1975 | Evans | 96/3 |
| 3,928,312 | 12/1975 | Fleckenstein | 96/3 |
| 3,929,760 | 12/1975 | Landholm et al. | 96/3 |
| 3,932,380 | 1/1976 | Krutak et al. | 96/3 |
| 3,942,987 | 3/1976 | Landholm et al. | 96/3 |

FOREIGN PATENTS OR APPLICATIONS

| | | |
|---|---|---|
| 768,397 | 6/1971 | Belgium |
| 674,082 | 11/1963 | Canada |
| 928,559 | 6/1973 | Canada |
| 2,203,634 | 8/1972 | Germany |
| 2,406,664 | 8/1975 | Germany |
| 1,212,051 | 11/1970 | United Kingdom |
| 1,306,176 | 2/1973 | United Kingdom |
| 1,330,524 | 9/1973 | United Kingdom |
| 1,283,835 | 8/1972 | United Kingdom |

*Primary Examiner*—David Klein
*Assistant Examiner*—Richard L. Schilling
*Attorney, Agent, or Firm*—Harold E. Cole

[57] ABSTRACT

Improved dye densities are obtained in color image transfer assemblages employing internal image emulsions, ballasted redox dye releasers and an alkaline processing composition containing a saturated, aliphatic or alicyclic glycol having from 3 to 10 carbon atoms or a saturated, aliphatic or alicyclic amino alcohol having from 2 to 10 carbon atoms.

23 Claims, No Drawings

PROCESSING COMPOSITIONS CONTAINING GLYCOLS FOR COLOR TRANSFER PROCESSES COMPRISING DIRECT POSITIVE SILVER HALIDE DEVELOPEMENT

This invention relates to photography, and more particularly to photographic assemblages for color diffusion transfer photography wherein the processing composition contains certain saturated, aliphatic or alicyclic glycols or amino alcohols.

Various formats for color integral transfer elements are described in the prior art, such as U.S. Pat. Nos. 3,415,644; 3,415,645; 3,415,646; 3,647,437; 3,635,707; 3,766,815 and Canadian Patents 928,559 and 674,082. In these formats, the image-receiving layer containing the photographic image for viewing can remain permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photo-sensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel-apart" formats for color diffusion transfer assemblages are described, for example, in U.S. Pat. Nos. 2,983,606; 3,362,819; and 3,362,821. In these formats, the image-receiving element is separated from the photo-sensitive element after development and transfer of the dyes to the image-receiving layer.

A problem has been found in connection with image transfer elements such as those described above when a direct positive, internal image emulsion is used. A fogging or nucleating agent is employed, usually in the emulsion itself, to fog the unexposed grains during development. The fogging agent can be of the ballasted nonadsorbed type such as those disclosed in U.S. Pat. No. 3,227,552, or it can be tightly adsorbed to the grains such as those described in U.S. application Ser. No. 601,891 of our coworkers Leone et al, filed Aug. 6, 1975.

Satisfactory Dmax values can be obtained when fogging agents of the nonadsorbed type are used at a concentration of about 1.5–5.0 g/mole of silver in the emulsion layer. At that level, however, the fogging agent decomposes under development conditions to produce significant amounts of gas bubbles (believed to be nitrogen). These bubbles can disrupt various other layers, such as an opaque processing composition layer, to allow unwanted light to expose the developing emulsion layers and produce dark spot defects. In addition, the rate of fogging with compounds of this type is directly dependent on the processing temperature. It would be desirable to be able to employ these compounds at a lower concentration to avoid the bubble problem, yet still be able to obtain a sufficient Dmax.

On the other hand, the adsorbed fogging agents referred to above are efficient nucleators at levels of only 3–20 mg/mole of silver in the emulsion layer. At such levels, which are only 1/1000 of the previous level, gas formation is insignificant. Furthermore, many of these fogging agents are little affected by or even inversely dependent on processing temperature. Despite the efficiency of these fogging agents, however, increasing their concentration often does not achieve adequate Dmax. It would be desirable to employ these fogging agents if an adequate Dmax could be achieved.

When mixtures of the two types of fogging agents are used, the processing temperature latitude of the assemblage can be improved. It is desirable to utilize such mixtures, therefore, if a means can be found to lower the concentration of the nonadsorbed nucleating agent employed (to avoid the gas problem), yet still achieve an adquate Dmax.

We have found that a substantial increase in dye densities can be achieved in such assemblages by employing certain compounds in the processing composition. They are effective with each type of fogging agent described above, as well as mixtures thereof.

A photographic assemblage according to our invention comprises:

a. a support having thereon at least one photosensitive internal-image silver halide emulsion layer having associated therewith a ballasted redox dye releaser;
b. a dye image-receiving layer; and
c. an alkaline processing composition and means for discharging same within the assemblage, the assemblage containing a developing agent and a fogging agent, and wherein the alkaline composition contains a compound which is a saturated, aliphatic or alicyclic glycol having from 3 to 10 carbon atoms or a saturated, aliphatic or alicyclic amino alcohol having from 2 to 10 carbon atoms. Mixtures of such compounds are also useful. Especially good results have been obtained with alicyclic diols, and alkanediols and -triols, all having from 3 to 10 carbon atoms.

Although the exact mechanism of the functioning of the invention is not known, it is believed that the addition of the above-described compounds to the processing composition accelerates fogging of the unexposed grains by the fogging agents as determined by measuring the amount of silver developed. This provides a greater image discrimination between the exposed areas (Dmin) and the unexposed areas (Dmax) with a resulting higher contrast. By varying the concentration of these compounds in the processing composition, it is also possible to control photographic sensitivity as well as Dmax.

Another advantage in using these particular compounds concerns the rupturable container or pod in which the alkaline processing composition containing the compounds is usually employed. The pod can generally be of the type disclosed in U.S. Pat. Nos. 2,543,181, 2,643,886, 2,653,732, 2,723,051, 3,056,492, 3,056,491 and 3,152,515. The pod is generally constructed of a laminate of paper, metal foil and a polymeric inner layer such as a poly(vinyl chloride) polymer. The laminate is usually folded longitudinally upon itself to form two walls which are sealed to one another along their longitudinal and end margins to form a cavity in which processing composition is contained. The compounds employed in our invention exert little solvent action on the pod liner to expand the film or weaken the pressure-sensitive seal. Aromatic alcohols such as benzyl alcohol and $\alpha,\alpha'$-xylendediol, on the other hand, do have substantial solvent action and cause swelling of the liner and weakening of the seal to such an extent that they are impractical, even though they may provide density boosts.

Saturated aliphatic or alicyclic glycols having from 3 to 10 carbon atoms which can be used in our invention include the following:

1,4-butanediol
1,3-butanediol
1,6-hexanediol
2,5-hexanediol
1,4-cyclohexanedimethanol
1,4-cyclohexanediol
1,10-decanediol
2,2-dimethyl-1,3-propanediol
2-ethyl-1,3-hexanediol
2-ethyl-2-hydroxymethyl-1,3-propanediol
2-methyl-2,4-pentanediol
1,5-pentanediol
1,3-propanediol and
2,2,4-trimethyl-1,3-pentanediol.

As mentioned above, the alicyclic diols, and alkanediols and triols provide especially good results.

Saturated, aliphatic or alicyclic amino alcohols having from 2 to 10 carbon atoms which can be used in our invention include the following:

2-amino-2-methyl-1,3-propanediol
3-amino-1-propanol
2-amino-1-propanol
ethanolamine
2-amino-2-methyl-1-propanol
4-amino-1-butanol
2-amino-1-butanol
5-amino-1-pentanol
6-amino-1-hexanol
3-dimethylamino-1-propanol 3-amino-3-methyl-1-butanol and
4-aminocyclohexanol.

The glycols and alcohols described above can be used in this invention in any concentration effective for the intended purpose. In general, the processing composition will contain such compounds at a concentration of from about 0.5 to about 15 g per liter, preferably 1 to 5 g/liter.

Various glycols and alcohols have been employed in certain photographic processes such as those disclosed in U.S. Pat. Nos. 2,304,925; 3,128,182; 3,552,969; 3,619,198, 3,640,721; 2,191,502; 2,371,740; 2,857,275; 2,909,430; 3,576,633; 3,619,185; 3,645,731; 2,984,567; 3,246,987; British Pat. No. 1,212,051; German Pat. No. 2,203,634; and Belgian Pat. No. 768,397. Triethanolamine is disclosed in U.S. Pat. No. 3,455,685 for use in a processing composition in a certain diffusion transfer element. U.S. Pat. No. 3,923,513 discloses benzyl alcohol in the processing composition in diffusion transfer elements similar to those used in this invention. In U.S. Pat. No. 2,909,430, phenylethyl alcohol is disclosed for use in a processing composition in a certain diffusion transfer element. U.S. Pat. No. 3,846,129 discloses benzyl alcohol, p-xylene-$\alpha,\alpha$-diol and diethylene glycol for use in processing compositions employed in diffusion transfer elements containing internal-image emulsions. None of these patents, however, teaches using the particular aliphatic compounds in the processing composition in accordance with this invention to process an element employing internal-image emulsions and ballasted redox dye releasers in order to obtain the particular advantages disclosed herein.

One embodiment of an assemblage of an integral transfer color element and a process for producing a photographic transfer image in color in which our invention can be employed is disclosed in Canadian Pat. No. 928,559. In this embodiment, the support for the photosensitive element is transparent and is coated with an image-receiving layer, a light-reflective layer, an opaque layer and photosensitive layers, having associated therewith dye image-providing material layers. A rupturable container containing the alkaline processing composition described above and an opacifier such as carbon black is positioned adjacent the top layer and a transparent cover sheet. The cover sheet comprises a transparent support which is coated with a neutralizing layer and a timing layer. the film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the assemblage to protect it from exposure. The processing composition develops each silver halide layer and dye images are formed as a result of development which diffuse to the image-receiving layer to provide a right-reading image which is viewed through the transparent support on the opaque reflecting layer background. For further details concerning the format of this particular integral assemblage, reference is made to the above-mentioned Canadian Pat. No. 928,559, which is incorporated herein by reference.

Another embodiment of an assemblage of an integral transfer color element and a process for producing a photographic transfer image in color in which our invention can be employed is described in U.S. Pat. No. 3,415,644. In this embodiment, the negative comprises an opaque support which is coated with photosensitive layers having associated therewith dye image-providing material layers. A rupturable container containing the alkaline processing composition described above, $TiO_2$ and an indicator dye (see U.S. Pat. No. 3,647,437) is positioned adjacent the top layer and a transparent receiver. The receiver comprises a transparent support which is coated with a neutralizing layer, a timing layer and an image-receiving layer. The film unit is placed in a camera, exposed through the transparent receiver and then passed through a pair of pressure-applying members in the camera as it is being removed therefrom. The pressure-applying members rupture the container and spread processing composition, $TiO_2$ and indicator dye over the image-forming portion of the assemblage to protect it from exposure. The processing composition develops each silver halide layer and dye images are formed as a result of development which diffuse to the image-receiving layer which is viewed through the transparent support on a white background — the indicator dye having "shifted" to a colorless form as the alkali is consumed by the neutralizing layer. For further details concerning the format of this particular assemblage, reference is made to the above-mentioned U.S. Pat. No. 3,415,644, which is incorporated herein by reference. Since the image in this embodiment is geometrically reversed, an image-reversing optical system such as a mirror in the camera is needed to reverse the image so that a right-reading image is viewable in the dye image-receiving layer.

Still other useful formats in which our invention can be employed are described in U.S. Pat. Nos. 3,362,819;

3,415,645; 3,415,646; 2,983,606; 2,543,181; 3,647,437; 3,635,707; British Pat. No. 1,330,524; and Canadian Pat. No. 674,082; the disclosures of which are hereby incorporated by reference.

The photosensitive element useful in our invention can be treated with an alkaline processing composition to effect or initiate development in any manner. A preferred method for applying processing composition is by use of rupturable container or pod which contains the composition. In general, the processing composition employed in our invention will also contain the developing agent for development. Where the developer is incorporated in the photosensitive element, the alkaline processing composition serves to activate the incorporated developer.

The dye image-providing materials which may be employed in our invention are nondiffusible or ballasted dye releasers. Such compounds are, generally speaking, compounds which can be oxidized by oxidized developing agent, i.e., cross-oxidized, to provide a species which as a function of oxidation will release a diffusible dye, such as by alkaline hydrolysis. Such dye releasers are described in U.S. Pat. No. 3,725,062 of Anderson and Lum issued Apr. 3, 1973; U.S. Pat No. 3,698,897 of Gompf and Lum issued Oct. 17, 1972; U.S. Pat. Nos. 3,443,939 and 3,443,940 of Bloom et al issued May 13, 1969; U.S. Pat. No. 3,928,312 of Fleckenstein issued Dec. 23, 1975; U.S. Pat. No. 3,929,760 of Landholm et al issued Dec. 20, 1975; U.S. Pat. No. 3,942,987 of Landholm et al issued Mar. 9, 1976; U.S. Pat. No. 3,932,380 of Krutak et al issued Jan. 13, 1976; and U.S. Published Patent Application Trial Voluntary Protest No. B-351,673 of Fleckenstein et al published Jan. 28, 1975; German OLS No. 2,406,664; U.S. Ser. Nos. 583,940 of Fleckenstein filed June 5, 1975, now U.S. Pat. No. 3,993,638; 439,809 of Kurtak et al filed Feb. 5, 1974, now U.S. Pat. No. 3,954,476; 503,144 of Fleckenstein et al filed Sept. 4, 1974; Ser. No. 590,899 of Haase et al filed June 27, 1975; Ser. No. 534,966 of Hinshaw et al filed Dec. 20, 1974; Ser. No. 589,977 of Hinshaw et al filed June 24, 1975; and Ser. No. 511,568 of Fields et al filed Oct. 20, 1974, now U.S. Pat. No. 3,980,479; the disclosures of which are hereby incorporated by reference.

In an especially preferred embodiment of our invention, the dye releasers such as those in the Fleckenstein et al patents and applications referred to above are employed. Such compounds are ballasted sulfonamido compounds which are alkalicleavable upon oxidation to release a diffusible dye from the nucleus and have the formula:

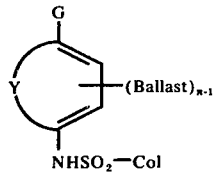

wherein:

a. Col is a dye or dye precursor moiety;

b. Ballast is an organic ballasting radical of such molecular size and configuration (e.g., simple organic groups or polymeric groups) as to render the compound nondiffusible in the photosensitive element during development in an alkaline processing composition at a pH of at least about 11;

c. G is OR or NHR$_1$ wherein R is hydrogen or a hydrolyzable moiety and R$_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc. (when R$_1$ is an alkyl group of greater than 6 carbon atoms, it can serve as a partial or sole Ballast group);

d. Y represents the atoms necessary to complete a benzene nucleus, a naphthalene nucleus, or a 5–7 membered heterocyclic ring such as pyrazolone, pyrimidine, etc; and e. *n* is a positive integer of 1 to 2 and is 2 when G is OR or when R$_1$ is a hydrogen or an alkyl group of less than 8 carbon atoms.

For further details concerning the above-described sulfonamido compounds and specific examples of same, reference is made to the above-mentioned Fleckenstein et al patents and applications referred to above.

The assemblage of the present invention may be used to produce positive images in single- or multicolors. In a three-color system, each silver halide emulsion layer of the film assembly will have associated therewith a dye image-providing material possessing a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous to the silver halide emulsion layer.

The concentration of the dye image-providing materials that are employed in the present invention may be varied over a wide range depending upon the particular compound employed and the results which are desired. For example, the dye image-providing compounds may be coated as dispersions in layers by using coating solutions containing a ratio between about 0.25 and about 4 of the dye image-providing compound to the hydrophilic filmforming natural material or synthetic polymer binder, such as gelatin, polyvinyl alcohol, etc., which is adapted to be permeated by aqueous alkaline processing composition.

Any silver halide developing agent can be employed in our invention depending upon the particular chemistry system involved. The developer may be employed in the photosensitive element to be activated by the alkaline processing composition. Specific examples of developers which can be employed in our invention include:

hydroquinone
N-methylaminophenol
Phenidone (1-phenyl-3-pyrazolidone)
Dimezone (1-phenyl-4,4-dimethyl-3-pyrazolidinone)
aminophenols
N-N-diethyl p-phenylenediamine
3-methyl-N,N-diethyl-p-phenylenediamine
N,N,N′,N′-tetramethyl-p-phenylenediamine
4-hydroxymethyl-4-methyl-1-phenyl-3-pyrazolidinone 4,4-bis(hydroxymethyl)-1-phenyl-3-pyrazolidinone, etc.

The black and white developing agents are preferred, however, since the color developers are generally slower, can cause stain, and can cause dermatitis if not handled properly.

In using dye releaser compounds in our invention, the production of diffusible dye images is a function of development of the silver halide emulsions with a developing agent to form direct-positive silver images in the emulsion layers. Since the silver halide emulsion employed is an internal-image emulsion, which is developable in unexposed areas in the presence of a fogging agent, a positive image can be obtained on the dye image-receiving layer when dye releasers are employed which release dye where oxidized. After exposure of the film unit, the alkaline processing composition permeates the various layers to initiate development in the exposed photosensitive silver halide emulsion layers. The developing agent present in the film unit develops each of the silver halide emulsion layers in the unexposed areas (since the silver halide emulsions are internal-image ones), thus causing the developing agent to become oxidized imagewise corresponding to the unexposed areas of the silver halide emulsion layers. The oxidized developing agent then crossoxidizes the dye-releaser compound, the oxidized form of which undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuse to the image-receiving layer to form a positive image of the original subject.

Internal-image silver halide emulsions useful in this invention are direct-positive emulsions that form latent images predominantly inside the silver halide grains, as distinguished from silver halide grains that form latent images predominantly on the surface thereof. Such internal-image emulsions were described by Davey et al in U.S. Pat. No. 2,592,250 issued Apr. 8, 1952, and elsewhere in the literature. Other useful emulsions are described in U.S. Pat. Nos. 3,761,276; 3,761,266; 3,761,267 and 3,703,584, the disclosures of which are hereby incorporated by reference. Internal-image silver halide emulsions can be defined in terms of the increased maximum density obtained when developed to a negative silver image with "internal-type" developers over that obtained when developed with "surface-type" developers. Suitable internal-image emulsions are those which, when measured according to normal photographic techniques by coating a test portion of the silver halide emulsion on a transparent support, exposing to a light-intensity scale having a fixed time between 0.01 and 1 second, and developing for 3 minutes at 20° C in Developer A below ("internal-type" developer) have a maximum density at least five times the maximum density obtained when an equally exposed silver halide emulsion is developed for 4 minutes at 20° C in developer B described below ("surface-type" developer). Preferably, the maximum density in Developer A is at least 0.5 density unit greater than the maximum density in Developer B.

| DEVELOPER A | |
|---|---|
| Hydroquinone | 15 g |
| Monomethyl-p-aminophenol sulfate | 15 g |
| Sodium sulfite (desiccated) | 50 g |
| Potassium bromide | 10 g |
| Sodium hydroxide | 25 g |
| Sodium thiosulfate | 20 g |
| Water to make one liter. | |
| **DEVELOPER B** | |
| P-hydroxyphenylglycine | 10 g |
| Sodium carbonate | 100 g |
| Water to make one liter. | |

The internal-image silver halide emulsions when processed in the presence of fogging or nucleating agents provide direct positive silver images. Such emulsions are particularly useful in the above-described embodiment. Suitable fogging agents include the hydrazines disclosed in Ives U.S. Pat. Nos. 2,588,982 issued Mar. 11, 1952 and U.S. Pat. No. 2,563,785 issued Aug. 7, 1951; the hydrazides and hydrazones disclosed in Whitmore U.S. Pat. No. 3,227,552 issued Jan. 4, 1966; hydrazone quaternary salts described in British Pat. No. 1,283,835; and U.S. Pat. No. 3,615,615; hydrazone containing polymethine dyes described in U.S. Pat. No. 3,718,470; and the acylhydrazinophenylthioureas disclosed in copending applications Ser. Nos. 601,891 and 601,888 of Leone et al filed Aug. 6, 1975; or mixtures thereof, the disclosures of which are hereby incorporated herein by reference. Hydrazide fogging agents are especially preferred. The quantity of fogging agent employed can be widely varied depending upon the results desired. Generally, the concentration of fogging agent employed will be from about 0.4 to about 8 g per mole of silver in the photosensitive layer, when the fogging agent is in the emulsion layer, or from about 0.1 to about 2 grams per liter of developer, if the fogging agent is located in the developer. The fogging agents described in U.S. Pat. Nos. 3,615,615 and 3,718,470, however, are preferably used in concentrations of 50 to 400 mg per mole of silver in the photosensitive layer.

The various silver halide emulsion layers of a color film assembly of the invention can be disposed in the usual order, i.e.; the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

While the alkaline processing composition used in this invention can be applied to the assemblage by the use of rupturable containers as described previously, other means for discharging the composition within the assemblage could also be used, e.g., interjecting the compositions with communicating members similar to hypodermic syringes which are attached either to a camera or camera cartridge.

In a color photographic assemblage according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104; 3,043,692; 3,044,873; 3,061,428; 3,069,263; 3,069,264; 3,121,011 and 3,427,158.

Generally speaking, except where noted otherwise, the silver halide emulsion layers in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 1 to 7 microns in thickness; and the alkaline solution-permeable polymeric interlayers, e.g., gelatin, are about 0.5 to 5 microns in thickness. Of course, these thicknesses are approximate only and can be modified according to the product desired.

The alkaline solution-permeable, light-reflective layer employed in certain embodiments of photographic assemblages of our invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix, such as, for example, gelatin, polyvinyl alcohol, and the like. Brightening agents such as the stilbenes, coumarins, triazines and oxazoles can also be added to the light-reflective layer, if desired. When it is desired to increase the opacifying capacity of the light-reflective layers, dark-colored opacifying agents, e.g., pH-indicator dyes, may be added to it, or carbon black, nigrosine dyes, etc., may be coated in a separate layer adjacent to the light-reflective layer.

A neutralizing layer employed in certain embodiments of our invention will usually increase the stability of the transferred image. Generally, the layer will effect a reduction in the pH of the image layers from about 13 or 14 to at least 11 and preferably 4–8 within a short time after imbibition. For example, polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030 may be employed with good results. Such neutralizing or pH-lowering materials reduce the pH of the film unit after development to terminate development and substantially reduce further dye transfer and thus stabilize the dye image.

An inert timing or spacer layer can be employed in certain embodiments of our invention over the neutralizing layer which "times" or controls the pH-reduction as a function of the rate at which alkali diffuses throughout the inert spacer layer. Examples of such timing layers include any of those disclosed in U.S. Pat. Nos. 3,455,686; 3,421,893; 3,419,389; 3,433,633; 3,575,701; 3,785,815 and 3,856,522. The timing layer may also be effective in evening out the various reaction rates over a wide range of temperatures, e.g., premature pH reduction is prevented when imbibition is effected at temperatures above room temperature, for example, at 35° to 40° C. The timing layer is usually about 0.2 to about 14 $\mu$m in thickness. Good results are obtained when the timing layer comprises a hydrolyzable polymer or a mixture of such polymers which are slowly hydrolyzed by the processing composition. Examples of such hydrolyzable polymers include polyvinyl acetate, polyamides, cellulose esters, etc. Especially good results are obtained with mixtures of cellulose acetate and maleic anhydride copolymers as described and claimed in copending U.S. application Ser. No. 521,221 of Abel filed Nov. 5, 1974.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino guanidine derivatives of vinyl methyl ketone such as described by Minsk, U.S. Pat. No. 2,882,156 issued Apr. 14, 1959, and basic polymeric mordants such as described in U.S. Pat. Nos. 3,788,855, 3,758,445, 3,488,706, 3,639,357, 3,557,066, 3,709,690, 3,625,694, 3,898,088 and 3,859,096. Other mordants useful in our invention include poly-4-vinylpyridine, the 2-vinyl pyridine polymer, metho-p-toluene sulfonate and similar compounds described by Sprague et al, U.S. Pat. No. 2,484,430 issued Oct. 11, 1949, and cetyl trimethylammonium bromide, etc. Effective mordanting compositions are also described in U.S. Pat. No. 3,271,148 by Whitmore and U.S. Pat. No. 3,271,147 by Bush, both issued Sept. 6, 1966, and U.S. Ser. No. 525,248 by Campbell et al filed Nov. 19, 1974.

Other materials useful in the dye image-receiving layer include alkaline solution-permeable polymeric layers such as N-methoxymethyl polyhexylmethylene adipamide; partially hydrolyzed polyvinyl acetate; and other materials of a similar nature. Generally, good results are obtained when the image-receiving layer, preferably alkaline solution-permeable, is transparent and about 1 to about 5 $\mu$m in thickness. This thickness, of course, can be modified depending upon the result desired. The image-receiving layer can also contain ultraviolet absorbing materials to protect the mordanted dye images from fading due to ultraviolet light, brightening agents such as the stilbenes, coumarins, triazines, oxazoles, dye stabilizers such as the chromanols, alkylphenols, etc.

The alkaline processing composition employed in this invention contains the compounds described previously and the conventional aqueous solution of an alkaline material, e.g., sodium hydroxide, sodium carbonate, or an amine such as diethylamine, possessing a pH of at least about 11, and preferably containing a developing agent as described previously. The solution also preferably contains a viscosity-increasing compound such as a high-molecular-weight polymer, e.g., a water-soluble ether inert to alkaline solutions such as hydroxy-ethyl cellulose or alkali metal salts of carboxymethyl cellulose such as sodium carboxymethyl cellulose. A concentration of viscosity-increasing compound of about 1 to about 5% by weight of the processing composition is preferred which will impart thereto a viscosity of about 100 cps. to about 200,000 cps. In certain embodiments of our invention, an opacifying agent, e.g., $TiO_2$, carbon black, indicator dyes, etc., may be added to the processing composition. In addition, ballasted indicator dyes and dye precursors may also be present in the photographic assemblage as a separate layer on the exposure side of the photosensitive layers, the indicator dyes being preferably transparent during exposure and becoming colored or opaque after contact with alkali from the processing composition.

The supports for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethylene terephthalate) film, polycarbonate film, poly-α-olefins such as polyethylene and polypropylene film, and related films or resinous materials. The support is usually about 2 to 9 mils in thickness. Ultraviolet absorbing materials may also be included in the supports or as a separate layer on the supports if desired.

The silver halide emulsions useful in our invention can be spectrally sensitized as described on pp. 108–109, paragraph XV, "Spectral Sensitization", of *Product Licensing Index*, Vol. 92, December 1971, publication 9232; they can be protected against the production of fog and can be stabilized against loss of sensitivity during keeping by employing the materials described on p. 107, paragraph V, "Antifoggants and stabilizers", of the above article; they can contain development modifiers, hardeners, and coating aids as described on pp. 107–108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition", of the above article; and they can be coated by using the various techniques disclosed on p. 109, paragraph XVIII, "Coating procedures", of the above article, the disclosures of which are hereby incorporated by reference.

The following examples further illustrate the invention.

EXAMPLE 1

An integral multicolor photographic element was prepared by coating the following layers in the order given on a poly(ethylene terephthalate) film support (coverages in parenthesis in g/m² unless otherwise indicated):

1. image-receiving layer of a poly[styrene-co-N-benzyl-N,N-dimethyl-N-vinylbenzyl-co-divinylbenzene] latex (2.2) and gelatin (2.2);
2. reflecting layer of titanium dioxide (21.5) and gelatin (3.2);
3. opaque layer of carbon black (2.7) and gelatin (1.7);
4. cyan dye redox releaser Compound A (0.54) in diethyllauramide (0.27) dispersed in gelatin (1.1);
5. interlayer of gelatin (0.54);
6. red-sensitive, direct-positive, internal image gelatinsilver bromide emulsion (1.2 Ag, 1.1 gelatin), 5-sec-octadecylhydroquinone-2-sulfonic acid (16g/mole silver) and fogging agent Compound D (150 mg/mole silver) and fogging agent compound E (6.4 mg/mole silver);
7. interlayer of gelatin (1.1) and 2,5-di-sec-dodecylhydroquinone (1.1);
8. magenta dye redox releaser Compound B (0.54) in diethyllauramide (0.27) dispersed in gelatin (1.1);
9. green-sensitive, direct-positive, internal image gelatinsilver bromide emulsion (1.35 Ag, 100 gelatin), 5-sec-octadecylhydroquinone-2-sulfonic acid (16 g/mole Ag), and fogging agent Compound D (240 mg/mole Ag) and fogging agent Compound E (4.8 mg/mole silver);
10. interlayer of gelatin (1.2) and 2,5-di-sec-dodecylhydroquinone (1.1).
11. yellow dye redox releaser Compound C (0.86) in diethyllauramide (0.43) dispersed in gelatin (1.1)
12. blue-sensitive, direct-positive, internal-image gelatinsilver bromide emulsion (1.25 Ag, 1.1 gelatin), 5-sec octadecyl-5-hydroquinone-2-sulfonic acid (16 g/mole Ag), and fogging agent Compound E (11 mg/mole Ag); and
13. overcoat layer of gelatin (0.54) and 2,5-di-sec dodecylhydroquinone (0.11).

COMPOUND A

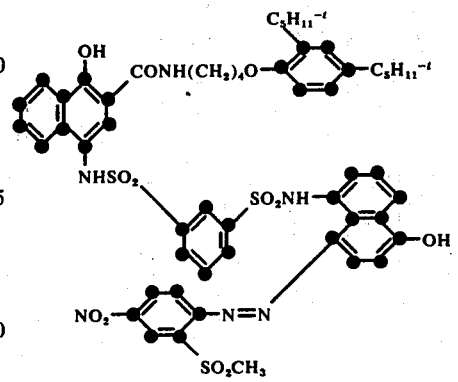

COMPOUND B

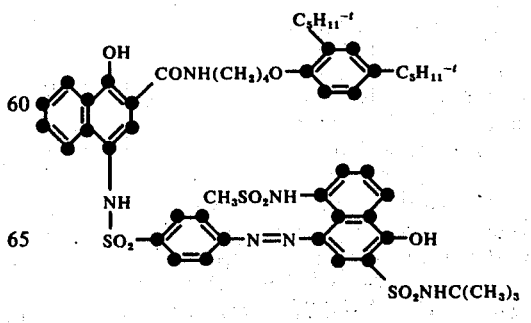

COMPOUND C

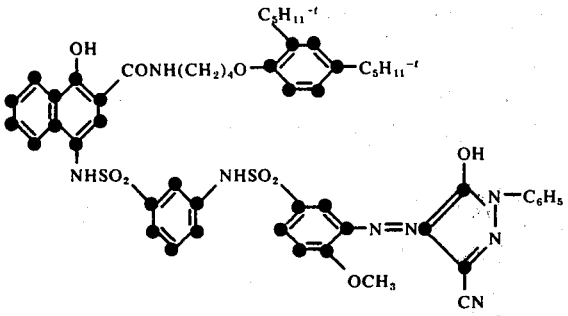

COMPOUND D 1-acetyl-2-{4-[5-amino-2-(2,4-di-tert-pentylphenoxy)benzamido]phenyl}-hydrazine

COMPOUND E

1-[4-(2-formylhydrazino)phenyl]-3-phenylthiourea

A cover sheet was prepared by coating the following layers on a transparent poly(ethylene terephthalate) support:

a. polymeric acid layer containing 0.20 meq/m² of poly(butyl acrylate-co-acrylic acid) (30/70 weight ratio), and b. a timing layer of a 95/5 mixture of cellulose acetate (40% acetyl) and poly(styrene-co-maleic anhydride) (4.3 g/m²).

Samples of the photographic element described above were exposed through a graduated multicolor test object. The processing compositions A – F listed below were spread between samples of the exposed element and cover sheet at 22° C by passing the transfer "sandwich" between a pair of juxtaposed rollers so that the liquid layer was about 75 μm.

| Processing Composition A (Control) | |
|---|---|
| potassium hydroxide | 50.0 g |
| 4-hydroxymethyl-4-methyl-1-phenyl-3-pyrazolidone | 12.0 g |
| 5-methylbenzotriazole | 4.0 g |
| t-butylhydroquinone | 0.3 g |
| methylhydroquinone | 0.1 g |
| sodium sulfite | 1.0 g |
| carboxymethylcellulose | 44.0 g |
| Tamol SN (trademark) dispersant | 8.8 g |
| carbon | 172.0 g |
| Water to | 1.0 liter |

PROCESSING COMPOSITION B

Same as A plus 2 g/liter of 1,4-cyclohexanedimethanol.

PROCESSING COMPOSITION C

Same as A plus 2 ml/liter of 1,6-hexanediol.

PROCESSING COMPOSITION D

Same as A plus 2 ml/liter 3-amino-1-propanol

PROCESSING COMPOSITION E

Same as A plus 10 ml/liter of 2-amino-1-propanol

PROCESSING COMPOSITION F

Same as A plus 5 ml/liter of 5-amino-1-pentanol

Sensitometric curves on the above elements were read by color reflection densitometry within three hours. The table below shows the increase in density obtained by using our invention. The red, green and blue Dmax values for the control were 1.76, 1.67 and 1.45, respectively. At the log E values where the densities for the control curves were 1.0, the density increases for the other elements were measured as follows:

| Processing Composition | Density Increases from 1.0 | | |
|---|---|---|---|
| | Red | Green | Blue |
| A (control) | 0 | 0 | 0 |
| B | 0.50 | 0.39 | 0.44 |
| C | 0.65 | 0.44 | 0.47 |
| D | 0.39 | 0.24 | 0.13 |
| E | 0.56 | 0.24 | 0.09 |
| F | 1.28 | 0.97 | 0.86 |

The above results indicate that substantial density increases can be obtained when the various glycols and aminoalcohols are added to the processing composition in accordance with our invention.

EXAMPLE 2

Samples of an integral element of the type described in Example 1 were exposed and processed as in Example 1 except that the polymeric acid layer on the cover sheet was polyacrylic acid at 15.5 g/m², and the following processing compositions were employed:

| Processing Composition G (Control) | |
|---|---|
| potassium hydroxide | 56.0 g |
| 4-hydroxymethyl-4-methyl-1-phenyl-3-pyrazolidone | 8.0 g |
| 5-methylbenzotriazole | 2.4 g |
| t-butylhydroquinone | 0.2 g |
| sodium sulfite (anhyd.) | 2.0 g |
| carboxymethylcellulose | 40.0 g |
| Water | 1 liter |

PROCESSING COMPOSITION H

Same as G plus 10.0 g/liter of 1,4-cyclohexanedimethanol (CHDM)

Sensitometric results were measured as follows:

| Processing | Yellow | | Magenta | | Cyan | |
|---|---|---|---|---|---|---|
| Composition | Dmax | Dmin | Dmax | Dmin | Dmax | Dmin |
| G (control) | 1.32 | 0.23 | 0.72 | 0.21 | 0.73 | 0.18 |
| H (w/CHDM) | 2.30 | 0.27 | 1.91 | 0.24 | 1.77 | 0.19 |
| Difference | +0.98 | +.04 | +1.19 | +.03 | +1.04 | +.01 |

The data show a substantial increase in Dmax in all colors with only a negligible increase in Dmin as a result of adding CHDM to the processing composition in accordance with our invention.

EXAMPLE 3

An integral multicolor photographic element of the type described in Example 40 of U.S. Published Patent Application B-351,673 was prepared and exposed as in Example 1. Samples of the cover sheet of Example 2 were employed to spread the processing compositions listed below at 24° C to form a layer 90 μm.

| Processing Composition J | |
|---|---|
| sodium hydroxide | 40.0 g |

-continued

| Processing Composition J | |
|---|---|
| 4-hydroxymethyl-4-methyl-1-phenyl-3-pyrazolidone | 8.0 g |
| t-butylhydroquinone | 0.4 g |
| 5-methylbenzotriazole | 2.4 g |
| sodium sulfite | 2.0 g |
| carbon | 40.0 g |
| hydroxyethylcellulose | 25.0 g |
| Water | 1 liter |

PROCESSING COMPOSITION K

Same as J plus 5 g/liter of ethanolamine

PROCESSING COMPOSITION L

Same as J plus 5 g/liter of 2-amino-2-methyl-1-propanol.

Sensitometric results were measured as follows:

| Processing | Dmax | | | Dmin | | |
|---|---|---|---|---|---|---|
| Composition | Red | Green | Blue | Red | Green | Blue |
| J (control) | 1.61 | 1.45 | 1.48 | 0.25 | 0.30 | 0.34 |
| K | 2.09 | 2.02 | 1.99 | 0.25 | 0.31 | 0.33 |
| L | 1.86 | 1.85 | 1.81 | 0.26 | 0.34 | 0.36 |

These results again demonstrated a substantial increase in Dmax with only a negligible increase in Dmin as a result of using a processing composition in accordance with out invention.

The invention has been described in detail with particular reference to certain preferred embodiments thereof, but it will be understood that variations and modifications can be effected within the spirit and scope of the invention.

We claim:

1. In a photographic assemblage comprising:

a. a support having thereon at least one photosensitive internal-image silver halide emulsion layer having associated therewith a ballasted redox dye releaser;

b. a dye image-receiving layer; and c. an alkaline processing composition and means for discharging same within said assemblage;

said assemblage containing a silver halide developing agent and a fogging agent, the improvement wherein said alkaline composition contains a compound which is a saturated, aliphatic or alicyclic glycol having from 3 to 10 carbon atoms or a saturated, aliphatic or alicyclic amino alcohol having from 2 to 10 carbon atoms.

2. The assemblage of claim 1 wherein said fogging agent is a hydrazide.

3. The assemblage of claim 1 wherein said compound is an alicyclic diol, an alkanediol or an alkanetriol, all having from 3 to 10 carbon atoms.

4. The assemblage of claim 1 wherein said compound is 1,4-cyclohexanedimethanol.

5. The assemblage of claim 1 wherein said compound is 1,6-hexanediol.

6. The assemblage of claim 1 wherein said compound is 3-amino-1-propanol.

7. The assemblage of claim 1 wherein said compound is 2-amino-1-propanol.

8. The assemblage of claim 1 wherein said compound is 5-amino-1-pentanol.

9. The assemblage of claim 1 wherein said compound is ethanolamine.

10. The assemblage of claim 1 wherein said compound is 2-amino-2-methyl-1-propanol.

11. The asemblage of claim 1 wherein said compound is present in said processing composition at a concentration of from about 0.5 to about 15 grams per liter.

12. The assemblage of claim 1 wherein:

a. said dye image-receiving layer is located between said support and said silver halide emulsion layer and b. said assemblage also includes a transparent cover sheet over the layer outermost from said support.

13. The assemblage of claim 12 wherein said cover sheet is coated with, in sequence, a neutralizing layer and a timing layer.

14. The assemblage of claim 13 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

15. An integral photographic assemblage comprising:

a. a photosensitive element comprising a transparent support having thereon the following layers in sequence: a dye image-receiving layer, an alkaline solution-permeable, light-reflective layer, an alkaline solution-permeable, opaque layer, a red-sensitive, internal-image silver halide emulsion layer having a ballasted redox cyan dye releaser associated therewith, a green-sensitive, internal-image silver halide emulsion layer having a ballasted redox magenta dye releaser associated therewith, and a blue-sensitive, internal-image silver halide emulsion layer having a ballasted redox yellow dye releaser associated therewith;

b. a transparent sheet superposed over said blue-sensitive silver halide emulsion layer and comprising a transparent support coated with, in sequence, a neutralizing layer and a timing layer; and c. a rupturable container containing an alkaline processing composition, and opacifying agent, and a compound which is a saturated, aliphatic or alicyclic glycol having from 3 to 10 carbon atoms or a saturated, aliphatic or alicyclic amino alcohol having from 2 to 10 carbon atoms, said container being so positioned during processing of said assemblage that a compressive force applied to said container will effect a discharge of the container's contents between said transparent sheet and said blue-sensitive silver halide emulsion layer;

said assemblage containing a silver halide developing agent and a fogging agent.

16. The assemblage of claim 15 wherein each said dye releaser is a ballasted sulfonamido compound which is alkalicleavable upon oxidation to release a diffusible color-providing moiety from the benzene nucleus, said compound having the formula:

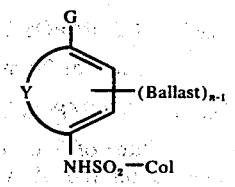

wherein:

a. Col is a dye or dye precursor moiety;

b. Ballast is an organic ballasting radical of such molecular size and configuration as to render said compound non-diffusible in said photosensitive element during development in an alkaline processing composition at a pH of at least about 11;

c. G is OR or $NHR_1$ wherein R is hydrogen or a hydrolyzable moiety and $R_1$ is hydrogen or an alkyl group of 1 to 22 carbon atoms;

d. Y represents the atoms necessary to complete a benzene nucleus, a naphthalene nucleus, or a 5–7 membered heterocyclic ring; and e. *n* is a positive integer of 1 to 2 and is 2 when G is OR or when $R_1$ is hydrogen or an alkyl group of less than 8 carbon atoms.

17. The assemblage of claim 16 wherein said fogging agent is a hydrazide.

18. The assemblage of claim 1 wherein said support having thereon said silver halide emulsion layer is opaque and said dye image-receiving layer is located on a separate transparent support superposed over the layer outermost from said opaque support.

19. The assemblage of claim 18 wherein said transparent support is coated with, in sequence, a neutralizing layer, a timing layer, and said dye image-receiving layer.

20. In a process for producing a photographic transfer image in color from an imagewise-exposed photosensitive element comprising a support having thereon at least one photosensitive internal-image silver halide emulsion layer having associated therewith a ballasted redox dye releaser; said process comprising treating said photosensitive element withan alkaline processing composition in the presence of a silver halide developing agent and a fogging agent to effect development of each of said exposed silver halide emulsion layers, whereby an imagewise distribution of dye is formed as a function of development and at least a portion of it diffuses to a dye image-receiving layer to provide said transfer image, the improvement comprising including in said alkaline processing composition a compound which is a saturated aliphatic or alicyclic glycol having from 3 to 10 carbon atoms or a saturated, aliphatic or alicyclic amino alcohol having from 2 to 10 carbon atoms.

21. The process of claim 20 wherein said fogging agent is a hydrazide.

22. The process of claim 20 wherein said compound is present in said processing composition at a concentration of from about 0.5 to about 15 grams per liter.

23. The process of claim 20 wherein said compound is an alicyclic diol, an alkanediol or an alkanetriol, all having from 3 to 10 carbon atoms.

* * * * *